US009994240B2

(12) United States Patent
Haigermoser et al.

(10) Patent No.: US 9,994,240 B2
(45) Date of Patent: Jun. 12, 2018

(54) CHASSIS FOR RAIL VEHICLES

(71) Applicant: Siemens AG Oesterreich, Vienna (AT)

(72) Inventors: Andreas Haigermoser, Oberhaag (AT); David Kreuzweger, Graz (AT); Olaf Koerner, Nuremberg (DE); Christian Kueter, Stattegg (AT); Hugo Rackl, Stattegg (AT); Andreas Schaefer-Enkeler, Roettenbach (DE); Peter Seitz, Pommelsbrunn (DE); Martin Teichmann, Graz (AT)

(73) Assignee: Siemens AG Österreich, Vienna (AT)

( * ) Notice: Subject to any disclaimer, the term of this patent is extended or adjusted under 35 U.S.C. 154(b) by 230 days.

(21) Appl. No.: 14/770,523

(22) PCT Filed: Feb. 26, 2014

(86) PCT No.: PCT/EP2014/053735

§ 371 (c)(1),
(2) Date: Aug. 26, 2015

(87) PCT Pub. No.: WO2014/135416

PCT Pub. Date: Sep. 12, 2014

(65) Prior Publication Data

US 2016/0001793 A1 Jan. 7, 2016

(30) Foreign Application Priority Data

Mar. 6, 2013 (AT) ..... A 50152/2013

(51) Int. Cl.
*B61F 1/06* (2006.01)
*B61F 5/30* (2006.01)
(Continued)

(52) U.S. Cl.
CPC ..... *B61F 1/06* (2013.01); *B61C 9/50* (2013.01); *B61C 17/00* (2013.01); *B61F 5/308* (2013.01)

(58) Field of Classification Search
CPC ..... B61F 1/00; B61F 3/00; B61F 3/04; B61F 5/00; B61F 5/26; B61F 5/28; B61F 5/30; B61F 5/301; B61F 5/305; B61F 5/52
See application file for complete search history.

(56) References Cited

U.S. PATENT DOCUMENTS 1,460,170 A 6/1923 Moore
5,611,284 A * 3/1997 Smith ..... B61F 5/305 105/218.1
2010/0307371 A1* 12/2010 Rodet ..... B61F 5/52 105/133

FOREIGN PATENT DOCUMENTS

CN 102026859 4/2011
CN 102039909 5/2011
(Continued)

OTHER PUBLICATIONS

Office Action dated Aug. 30, 2016 which issued in the corresponding Chinese Patent Application No. 201480012373.9.

*Primary Examiner* — Robert J McCarry, Jr.
(74) *Attorney, Agent, or Firm* — Cozen O'Connor

(57) ABSTRACT

A chassis for rail vehicles, particularly with inside-supported wheelsets, wherein the drive unit is elastically supported transversely to the travel direction via spring devices within the chassis frame, where the vibrational behavior is optimized and the space available for the drive unit is enlarged because the spring devices are supported directly on the housing of the bearing of the wheelset.

16 Claims, 6 Drawing Sheets

(51) Int. Cl.
*B61C 9/50* (2006.01)
*B61C 17/00* (2006.01)

(56) References Cited

FOREIGN PATENT DOCUMENTS

| | | | |
|---|---|---|---|
| CN | 201901134 | | 7/2011 |
| DE | 1181728 | B | 11/1964 |
| DE | 19531355 | A1 | 2/1997 |
| EP | 0308616 | | 3/1989 |
| EP | 0444016 | A2 | 8/1991 |
| EP | 0444016 | B1 | 8/1991 |
| EP | 0979190 | A1 | 2/2000 |
| EP | 0979190 | B1 | 2/2000 |
| GB | 124941 | A | 4/1919 |
| RU | 2067938 | | 10/1996 |
| WO | WO 2009/056415 | | 5/2009 |

* cited by examiner

FIG 8 Schnitt A - A

CHASSIS FOR RAIL VEHICLES

CROSS-REFERENCE TO RELATED APPLICATIONS

This is a U.S. national stage of application No. PCT/EP2014/053735 filed 26 Feb. 2014. Priority is claimed on Austrian Application No. 50152/2013 filed 6 Mar. 2013, the content of which is incorporated herein by reference in its entirety.

BACKGROUND OF THE INVENTION

1. Field of the Invention

The invention relates to a chassis for rail vehicles, particularly with inside-supported wheelsets, in which two wheelsets with a drive unit comprising a traction motor, transmission or coupling are mounted in a chassis frame, where at least parts of the drive unit are moveably elastically supported transversely to the travel direction via spring devices.

2. Description of the Related Art

In rail vehicles, a chassis executes lateral translational movements and rotary movements with respect to the vehicle. The dynamic reactions of the chassis as a result of a track fault become more severe with increasing speed as a result of the conical bearing surfaces of the wheels. This dynamic reaction, in the form of a rocking motion, is the reason for a critical speed, beyond which a vehicle can no longer be operated. A number of chassis parameters influence this critical speed, in addition to the conicity of the bearing surfaces of the wheels, rigidity of the wheelset mounting, wheel diameter, and, also the masses coupled to the wheelset. In this way, both the mass and also the rigidity and damping are important.

EP 0444016 B1 discloses a chassis in which the drive motor is rotatably mounted on the chassis frame at its end disposed in the travel direction, where at the opposite end the motor is connected to the chassis frame by way of leaf springs running in a perpendicular manner. The leaf springs are clamped with their ends between the motor and the chassis frame. As a result, the drive motor is suspended elastically and can oscillate elastically at right angles to the travel direction.

A chassis for electrical locomotives is likewise known from EP 0979190 B1, in which the drive motor can be moved in a translational manner at right angles to the travel direction of the vehicle, in order to play the role of an inertia damper. Here, the drive motor is suspended on the side of the axis with the aid of a suspension arm and on the side of the motor via two suspension arms on the chassis frame.

With these known chassis, the spring devices are always supported directly against the chassis frame. This is disadvantageous in that the spring travel is relatively large, it typically lies between the chassis frame and wheelset in the region of the drives at 25 to 50 mm vertical spring compression and at 15 to 35 mm spring expansion. In the transverse direction, an additional approximately +/−10 mm is also required for drive movements. This spring travel is not provided by the design of the drives but, instead, by the chassis construction, and can therefore also not be optimized to the drives so that on account of the relatively large oscillation amplitudes, the space available within the chassis frame is reduced for the drive unit, and drive motors with a higher performance are more difficult to accommodate.

SUMMARY OF THE INVENTION

It is therefore an object of the invention to provide a chassis rail that eliminates the foregoing disadvantages of conventional chassis.

This and other objects and advantage are achieved in accordance with the invention by providing a chassis for rail vehicles in which a spring device is fastened to the housing of at least one bearing of the wheelsets.

In accordance with the invention, the spring travel is as a result significantly shortened. The spring travel of the drive suspension can, in the inventive arrangement, be configured to the requirements of the drive and can typically be vertically shortened to +/−10 mm. In the transverse direction, only the spring travel required by the drive has to be received in the drive coupling and not also the additional spring travel of the chassis frame. The space available within the chassis frame is increased, so that it is not only the critical speed that is increased but also drive units with a higher performance can be accommodated within the chassis frame.

A maximum damper effect with an optimal tuning with respect to the transverse rigidity and transverse damping can in particular be achieved in a frequency range of approximately 1 to 10 Hz.

A particularly simple and advantageous embodiment of the spring device is produced, where the movement of the drive unit is limited elastically both in the vertical direction and also at right angles to the travel direction.

In some embodiments, the spring device comprises a connector fastened in an essentially horizontally arranged hole of the housing of the wheelset bearing, in which connector the lugs, formed as bolts and protruding from the drive unit, are arranged between elastic elements.

In another embodiment, the lugs of the drive unit, formed as bolts, are arranged on both sides of the shaft of the wheelset shaft and vertically at a distance.

In some embodiments, the drive unit is advantageously also to be fastened to the chassis frame as a torque support via a motor support bearing.

On account of the different arrangement of the flange-type lugs, drive units with a different performance and design can be arranged optimally within the chassis frame.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in more detail in the description below with the aid of a few exemplary embodiments with reference to the drawings, in which;

FIG. 8 shows a front view along the lines A-A in FIG. 7.

DETAILED DESCRIPTION OF THE EXEMPLARY EMBODIMENTS

Figure 1:
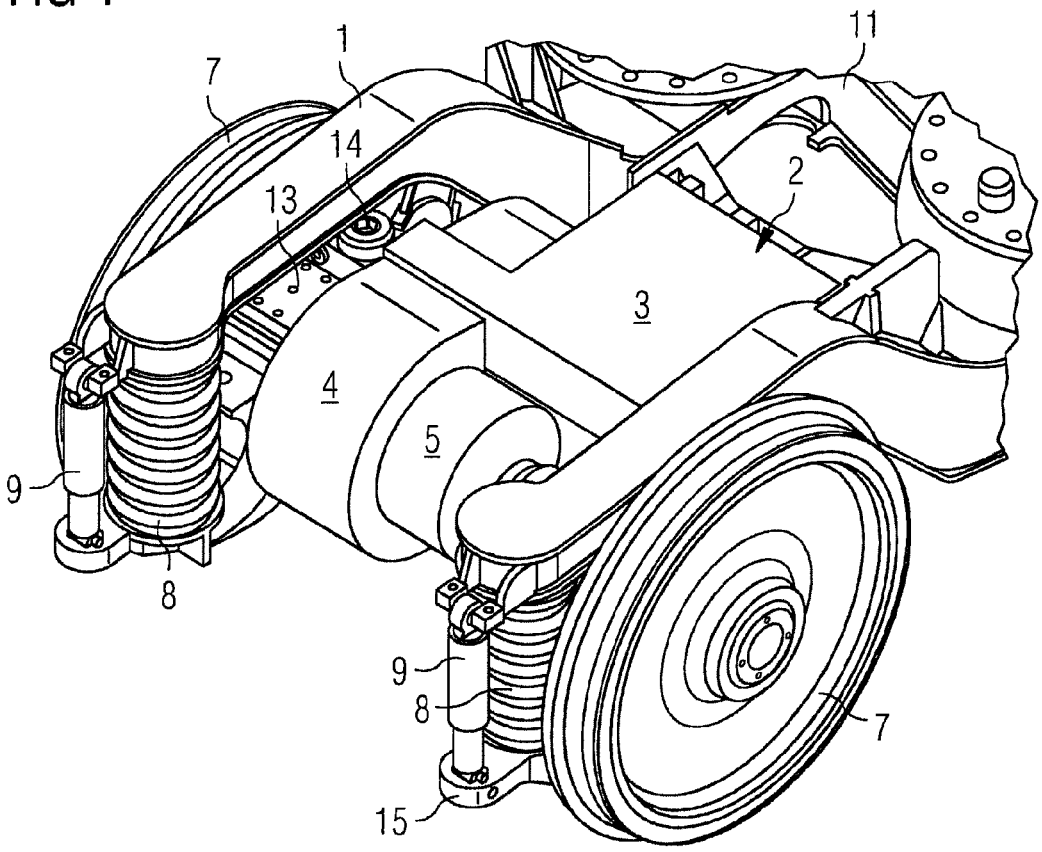
FIG. 1 shows a diagonal section of a lateral part of an inventive chassis with inside-supported wheelsets.
Figure 2A:
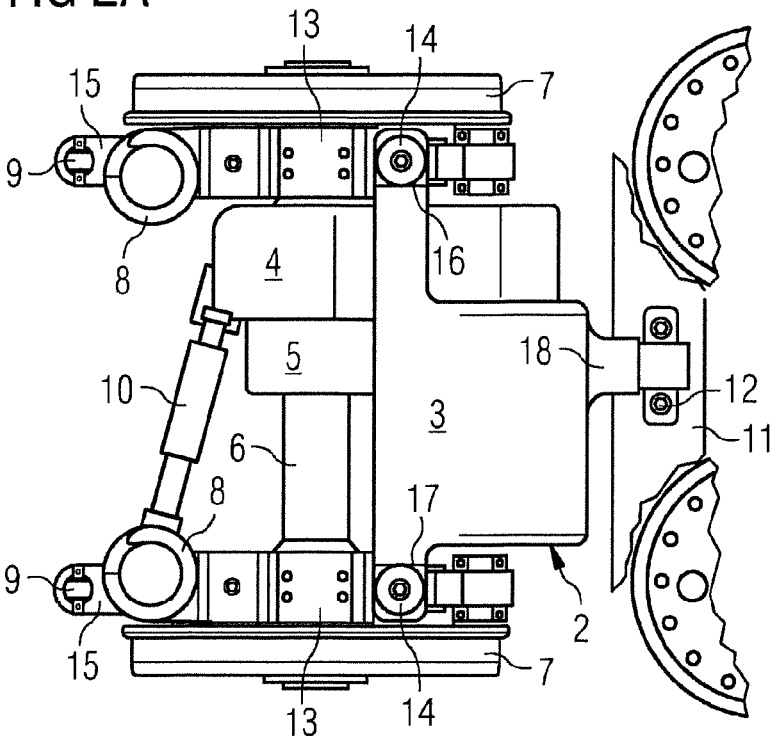
FIGS. 2A to 2D show a top view onto a chassis with four exemplary embodiments with respect to the arrangement of the inventive sprung support of the drive unit.

A lateral part of a chassis in accordance with the invention is shown in FIGS. 1 and 2A in a diagonal section or top view. The chassis frame is indicated with 1. The wheelset shaft 6 with the two wheels 7 is supported in wheelset bearings 13. The wheelset bearings 13 resting on a carrier 15 are connected to the chassis frame 1 via springs 8 and the shock absorbers 9. The drive unit 2 comprising an electric motor 3, a transmission 4 and coupling 5 is arranged within the chassis frame 1. The drive unit 2 is suspended at three points and for this purpose has three flange-type lugs 16, 17, 18 that are firmly connected to the drive unit 2. The lug 18 is connected to the chassis frame part 11 via a bearing 12 serving as a torque support. The bearing 12 allows for moveabilty of the drive unit 2 about a horizontal axis, and also provides a lateral rotational movement of the drive unit 2. The two other lugs 16, 17 are connected to inventive spring devices 14 fastened to the wheelset bearing 13. The spring devices 14, which are subsequently described in more detail with reference to FIGS. 3 and 7, allow for movement of the drive unit 2 laterally perpendicular to the travel direction and in the vertical direction. A damper element 10, which damps lateral movements is also arranged between the drive unit 2 and the chassis frame 1.

The damper element 10 is used as a damper for the dynamic reaction of the chassis in the transverse direction to optimally match the spring device and the drive mass. In accordance with a particularly advantageous embodiment, the damper element 10 is clamped between the housing 19 of the wheelset bearing 13 and the drive unit 2.

It is apparent from FIGS. 1 and 2 that the space within the chassis frame 1, contrary to conventional chassis, is wholly available for the drive unit 2, so that high performance electric motors can be accommodated. Moreover, it is apparent from the embodiment shown in FIG. 2A that the lateral motion of the drive unit 2 is restricted with fixed stops on account of the short spring travel of the spring devices 14 resting on the wheelset bearings 13.

Figure 2B:
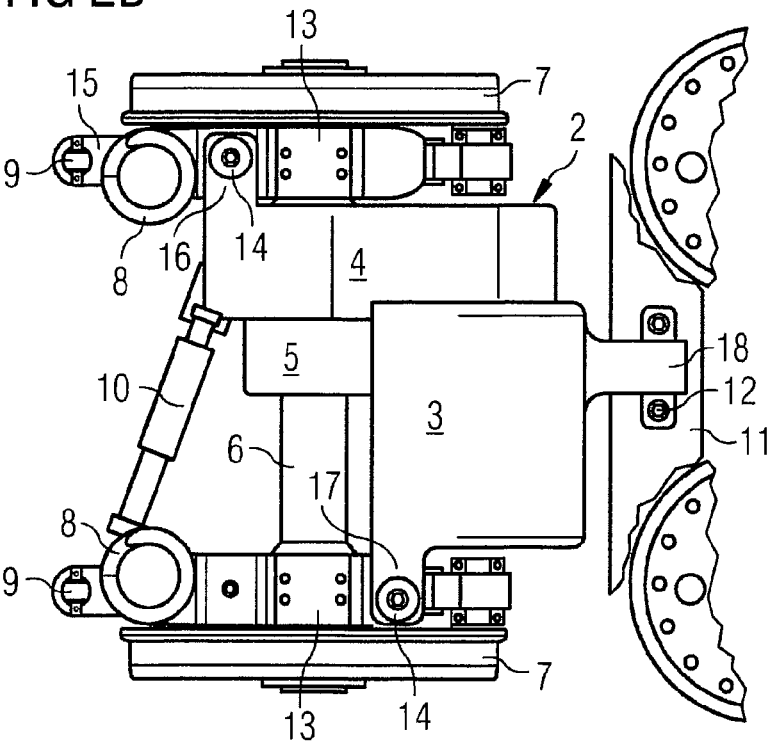
Figure 2C:
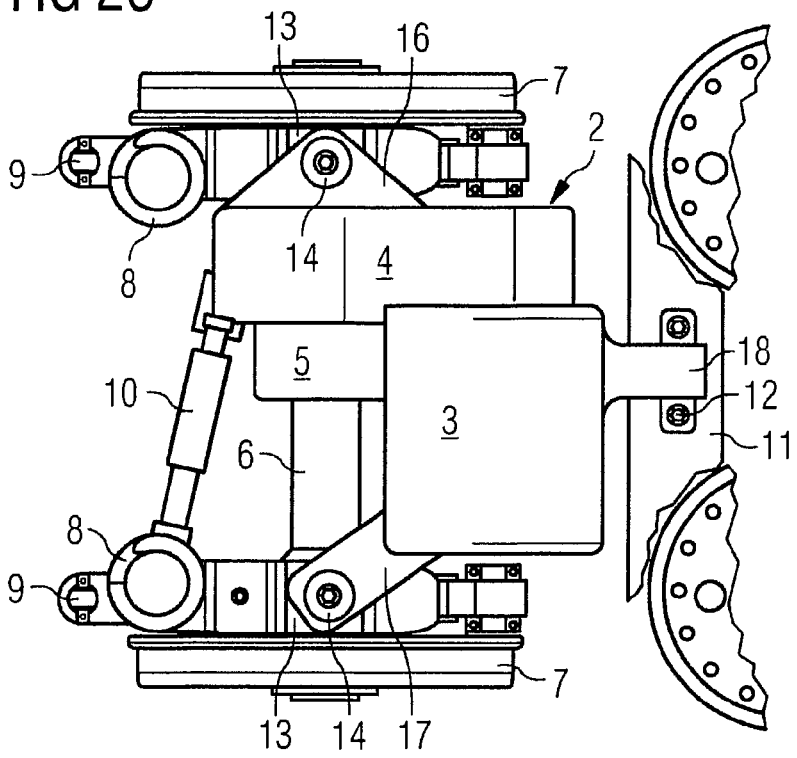
Figure 2D:
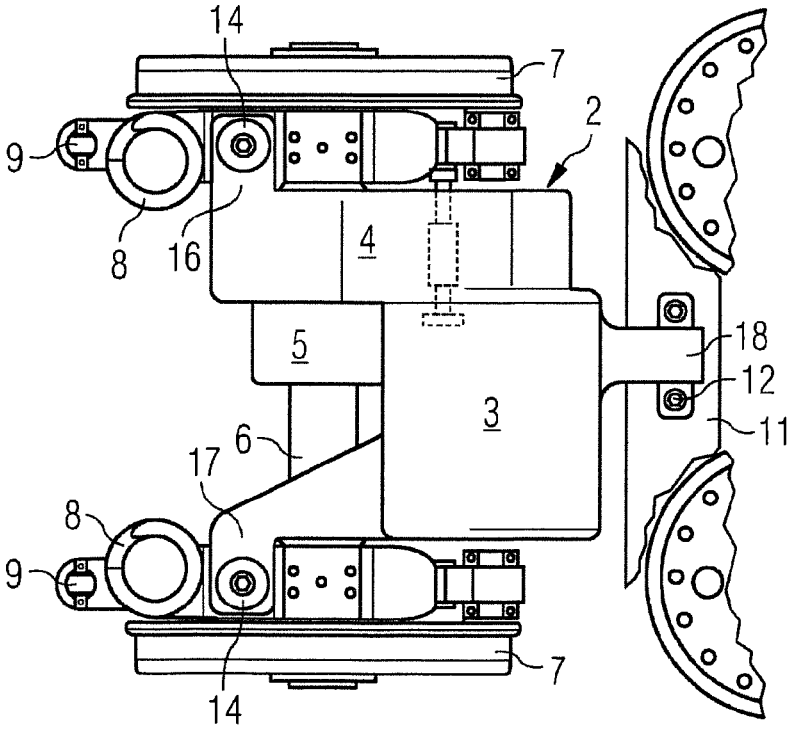

Further embodiments are shown in FIGS. 2B to 2D, in which the lugs 16, 17 with the associated spring devices 14 are arranged at different positions.

In FIGS. 2A to 2D, the same reference characters are used for the same chassis parts as in FIGS. 1 to 2A.

In the embodiment of FIG. 2B, the lugs 16, 17 and the associated spring devices 14 are arranged obliquely opposite one another on both sides of the wheelset shaft 6.

In FIG. 2C, the lugs 16, 17 and the spring devices 14 are arranged opposite one another at the height of the wheelset shaft 6, where the lug 17 extends at an oblique angle with respect to the wheelset shaft 6.

In the embodiment shown in FIG. 2D, the lugs 16, 17 and the associated spring devices 14 are arranged on the left side of the wheelset shaft 6 and facing one another.

On account of the different positioning of the lugs 16, 17 and the associated spring devices 14 of the embodiments of FIGS. 2A to 2D, drive units 2 of different structures can be arranged within the frame 1, where their vibrational behavior can also be adjusted individually.

Figure 3:
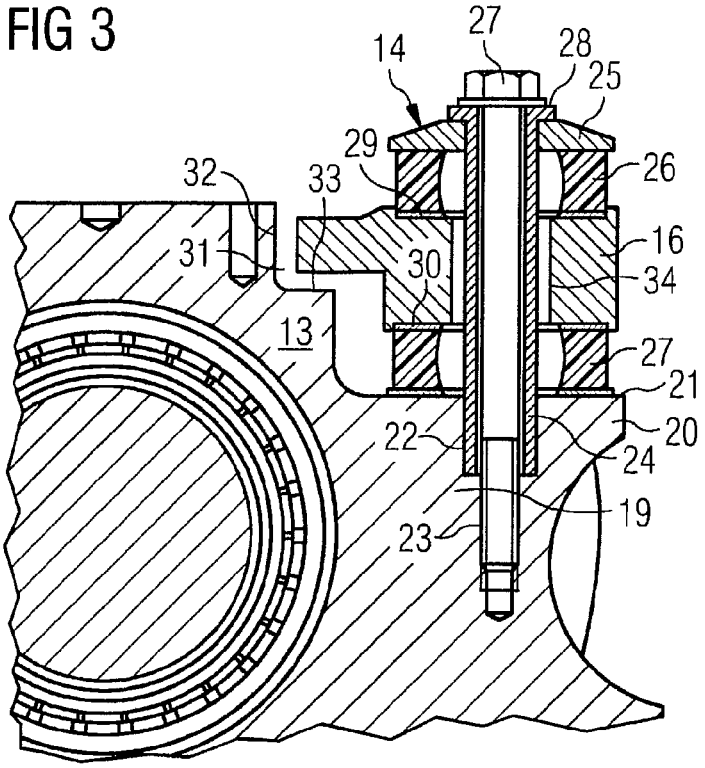
FIG. 3 shows a sectional view through an embodiment of an inventive spring device.

The spring device 14 of FIG. 3 is firmly screwed to the wheelset bearing housing 19. The flange-type lug provided with a hole 34 is identified with 16. The lug 16 is clamped between two planar elastic elements, preferably annular elements 26, 27. The wheelset bearing housing 19 has a section 20 with a support surface 21. In section 20, a hole 22 is provided which continues in a threaded bore 23. A steel sleeve 24 with a ring 28 arranged on the upper end is inserted into the hole 22 through a perforated pressure plate 25, the upper elastic annular body 26, the hole of the lug 16 and through the lower elastic element 27. A screw 27 with an outer thread provided in the lower region is guided through the steel sleeve 24 to the threaded hole 23. By tightening the screw 27, the elements 26, 27 are subjected to a prestress. The lug 16 is also provided with an annular stepped section 29, 30 resting on the annular bodies 26, 27 on the upper and lower side, so that the elastic elements 26, 27 can also absorb forces in the horizontal direction, i.e., at right angles to the travel direction. Furthermore, a step with stop surfaces 32, 33 is provided on the bearing housing 13. The forces exerted by the drive unit 2 via the lug 16 are limited in the vertical direction by the stop surface 33 and in the transverse direction by the stop surface 32.

By selecting the material of the elastic elements 26, 27 and by adjusting the prestress applied by the screw 27, the vibrational behavior of the drive unit 2 can be controlled over a large area.

The embodiment depicted in FIG. 3 also shows that the spring travel is relatively short and limited by stop surfaces 32, 33.

Figure 4:
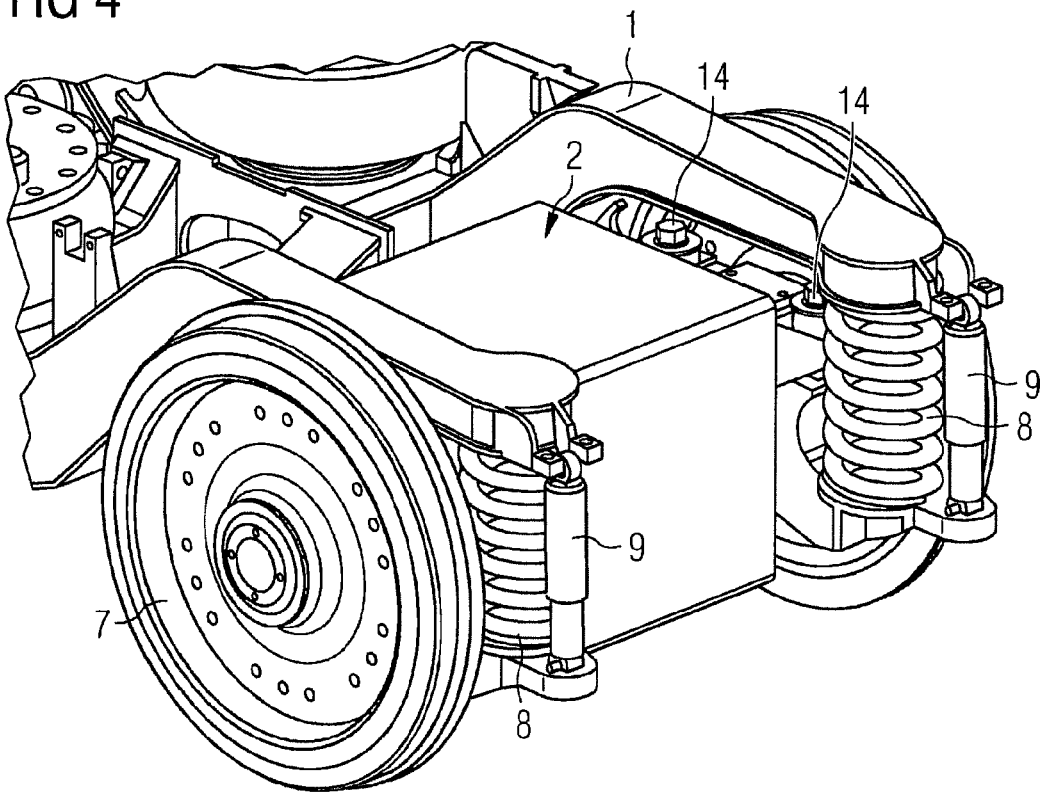
FIGS. 4 to 6 show views of a further embodiment of the invention with different arrangements of the spring device on the housing of the wheelset bearing.
Figure 5:
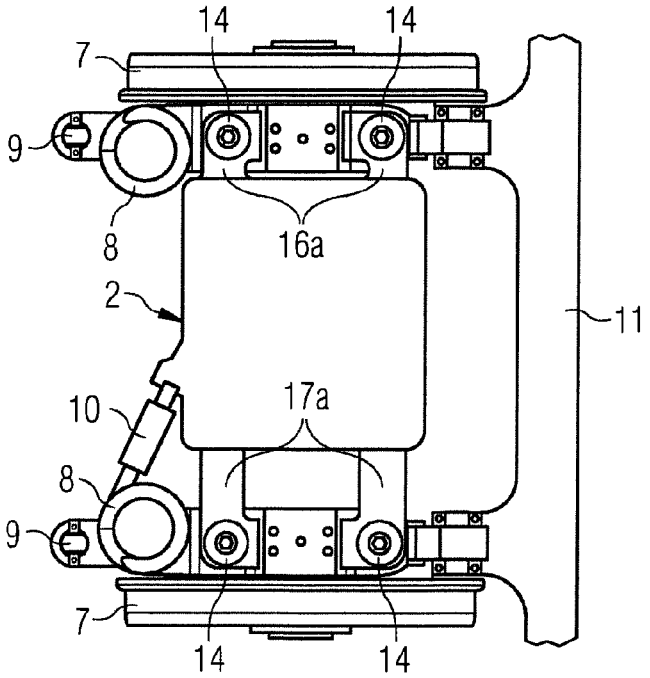
Figure 6:
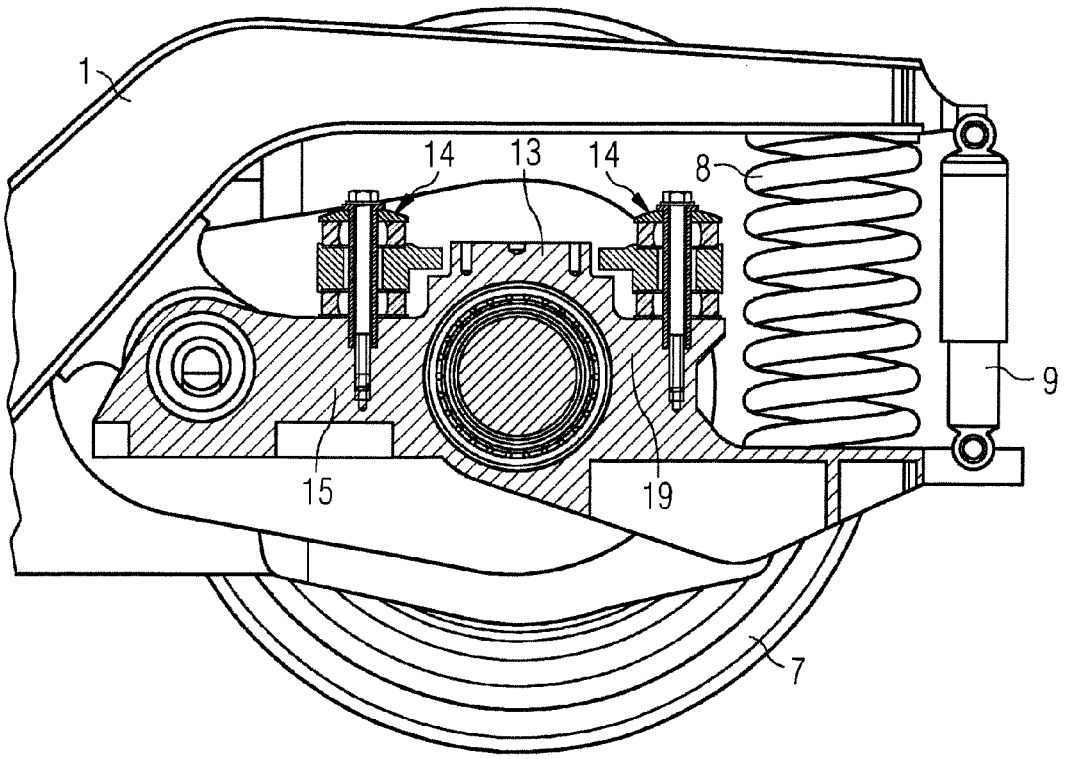

A further exemplary embodiment of a chassis in accordance with the invention is shown in FIGS. 4, 5 and 6. The same reference characters are used for the same chassis parts as in FIGS. 1 and 2*a*. This embodiment dispenses with a lug 18 fastened to the chassis part 11 and used as a torque support FIG. 2A. Instead, provision is made for four lugs (16, 17, 16*a*, 17*a*) arranged laterally on both sides of the wheelset shaft 6 and connected to the drive unit 2, where these lugs are elastically connected to four spring devices 15 arranged on the wheelset bearing housing 19. The arrangement and the fastening of the spring devices 14 on both sides of the wheelset shaft 6 on the bearing housing 19 are apparent from FIG. 6. Although a three-point support of the drive unit 2 is also sufficient without torque supports arranged on the chassis part 11, the four-point support of the drive unit 2 in accordance with the embodiment of FIGS. 4 to 6 has proven to be particularly advantageous.

Figure 7:
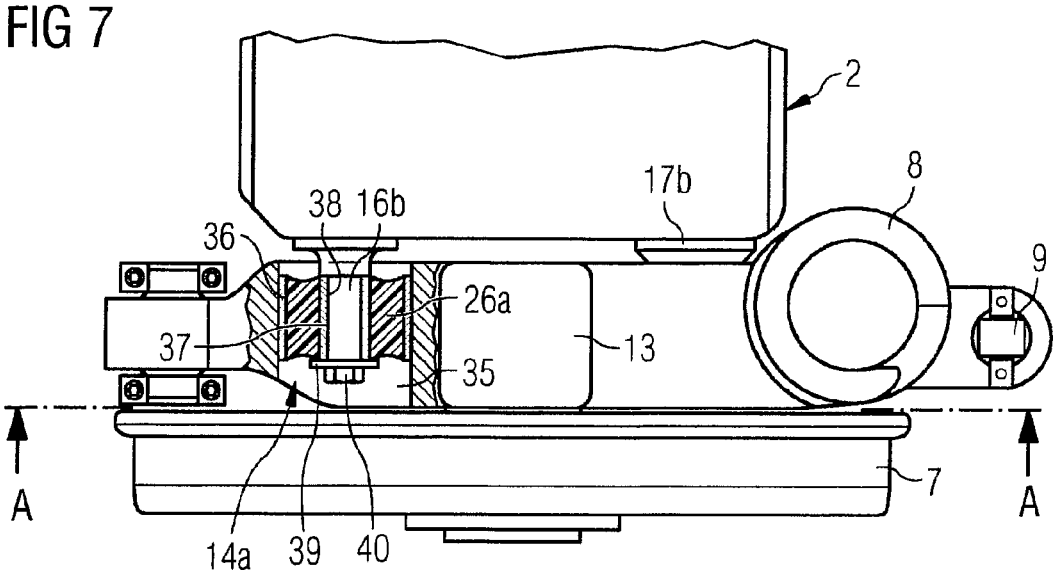
FIG. 7 shows a partial sectional view onto a wheelset bearing having a further embodiment of a spring device in accordance with the invention.
Figure 7:
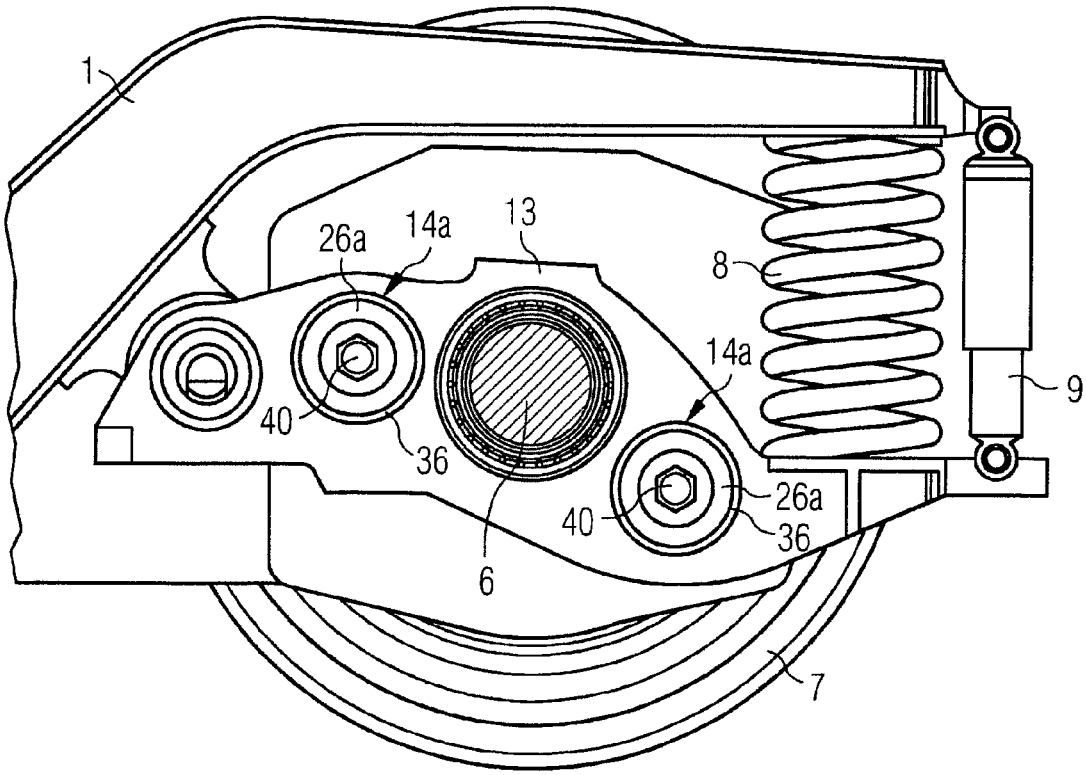

A further embodiment of a spring device in accordance with the invention is shown in FIGS. 7 and 8, where the same reference characters as in FIGS. 1 and 2A are used for the same chassis parts.

The housing 19 of the wheelset bearing 13 has a horizontal hole 35, into which a bush 36 is inserted. The lugs fastened to the drive unit 2 are formed as a bolt 16*b* inserted into a sleeve 37. The sleeve 37 is clamped between a step 38 of the bolt 16*b* and a cover disk 39 by tightening the screw 40. A pre-stressed elastic element 26*a* is inserted between the sleeve 37 and the bush 36.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis for rail vehicles in which wheelsets with a drive unit are supported in a chassis frame;

wherein at least parts of the drive unit are moveably elastically supported transversely to a travel direction via spring devices which permit lateral movement of the drive unit perpendicularly to the travel direction and in the vertical direction; and wherein each of the spring devices is fastened to a housing of at least one bearing of the wheelsets.

2. The chassis as claimed in claim 1, wherein a damper element is fastened between the housing of the at least one bearing of the wheelsets and the drive unit.

3. The chassis as claimed in claim 2, wherein the spring device also allows vertically absorbed movements in addition to transverse elastic lateral movements.

4. The chassis as claimed in claim 1, wherein a damper element is fastened between the chassis frame and the drive unit.

5. The chassis as claimed in claim 4, wherein the spring device also allows vertically absorbed movements in addition to transverse elastic lateral movements.

6. The chassis as claimed in claim 1, wherein the spring device also allows vertically absorbed movements in addition to transverse elastic lateral movements.

7. The chassis as claimed in claim 1, wherein the spring device comprises a vertical support fastened to the housing of the wheel bearing, upon which elastic elements are arranged, and against which flange-type lugs connected to the drive unit laterally abut.

8. The chassis as claimed in claim 7, wherein the vertical support comprises a steel sleeve fastened to a support surface of the housing of the at least one bearing and the lugs have a hole for receiving the steel sleeve and stop surfaces in a region of the hole on the bottom and top sides; and wherein the lugs are clamped in the region of the hole between two annular elements comprising elastic material and these elastic annular elements rest laterally on the stop surfaces, so that the drive unit can implement elastically lateral transverse and vertical movements via the lugs.

9. The chassis as claimed in claim 1, wherein the spring device comprises a connector fastened in an essentially horizontally arranged hole of the housing of the at least one bearing, in which connector the lugs embodied as bolts and protruding from the drive unit are arranged between elastic elements.

10. The chassis as claimed in claim 9, wherein the lugs of the drive unit form as bolts are arranged on both sides of a shaft of the wheelset and vertically at a distance.

11. The chassis as claimed in claim 1, wherein the drive unit is fastened to the chassis frame via motor support bearings as a torque support.

12. The chassis as claimed in claim 1, wherein two lugs of the drive unit are arranged parallel opposite to one another at a height of the shaft of the wheel set or laterally offset with respect to both sides of the shaft of the wheelset.

13. The chassis as claimed in claim 1, wherein at least one lug of the drive unit extends at an angle to the shaft of the shaft of the wheelset.

14. The chassis as claimed in claim 1, wherein two lugs are fastened laterally on the drive unit on both sides of the shaft of the wheelset, said lugs being connected to the housing of the at least one bearing of the wheelset via the spring device.

15. The chassis as claimed in claim 1, wherein the wheelsets are inside-supported wheelsets.

16. A chassis for rail vehicles in which wheelsets with a drive unit are supported in a chassis frame;

wherein at least parts of the drive unit are moveably elastically supported transversely to a travel direction via spring devices comprising a vertical support fastened to a housing of the wheel bearing, upon which elastic elements are arranged, and against which flange-type lugs connected to the drive unit laterally abut; and wherein each of the spring devices is fastened to a housing of at least one bearing of the wheelsets;

wherein the vertical support comprises a steel sleeve fastened to a support surface of the housing of the at least one bearing and the flange-type lugs have a hole for receiving the steel sleeve and stop surfaces in a region of the hole on the bottom and top sides; and wherein the flange-type lugs are clamped in the region of the hole between two annular elements comprising elastic material and these elastic annular elements rest laterally on the stop surfaces, so that the drive unit can implement elastically lateral transverse and vertical movements via the flange-type lugs.

* * * * *